US008328655B1

(12) United States Patent
Stroble

(10) Patent No.: US 8,328,655 B1
(45) Date of Patent: Dec. 11, 2012

(54) GOLF TRAINING TOOL

(76) Inventor: Robert L Stroble, Livonia, MI (US)

( * ) Notice: Subject to any disclaimer, the term of this patent is extended or adjusted under 35 U.S.C. 154(b) by 0 days.

(21) Appl. No.: 13/157,532

(22) Filed: Jun. 10, 2011

Related U.S. Application Data

(60) Provisional application No. 61/353,309, filed on Jun. 10, 2010.

(51) Int. Cl.
*A63B 69/36* (2006.01)

(52) U.S. Cl. ..... 473/257; 473/218; 473/272

(58) Field of Classification Search ..... 473/218, 473/219, 257, 266, 270, 272, 273
See application file for complete search history.

(56) References Cited

U.S. PATENT DOCUMENTS

| | | | | | |
|---|---|---|---|---|---|
| 2,652,251 | A | * | 9/1953 | Molinar | 473/218 |
| 5,362,060 | A | * | 11/1994 | Hinson | 473/218 |
| 5,482,284 | A | * | 1/1996 | Vandever | 473/218 |
| 5,599,240 | A | * | 2/1997 | Feldmeier | 473/218 |
| 5,730,659 | A | * | 3/1998 | Morita | 473/218 |
| 5,893,805 | A | * | 4/1999 | Douglass | 473/218 |

* cited by examiner

*Primary Examiner* — Nini Legesse

(57) ABSTRACT

A golf training aid having an alignment rod rotatably mounted to an elongated rail. The rail is pointed directly at the target while the rod is rotated and positioned along the rail pointing directly to the ball.

14 Claims, 12 Drawing Sheets

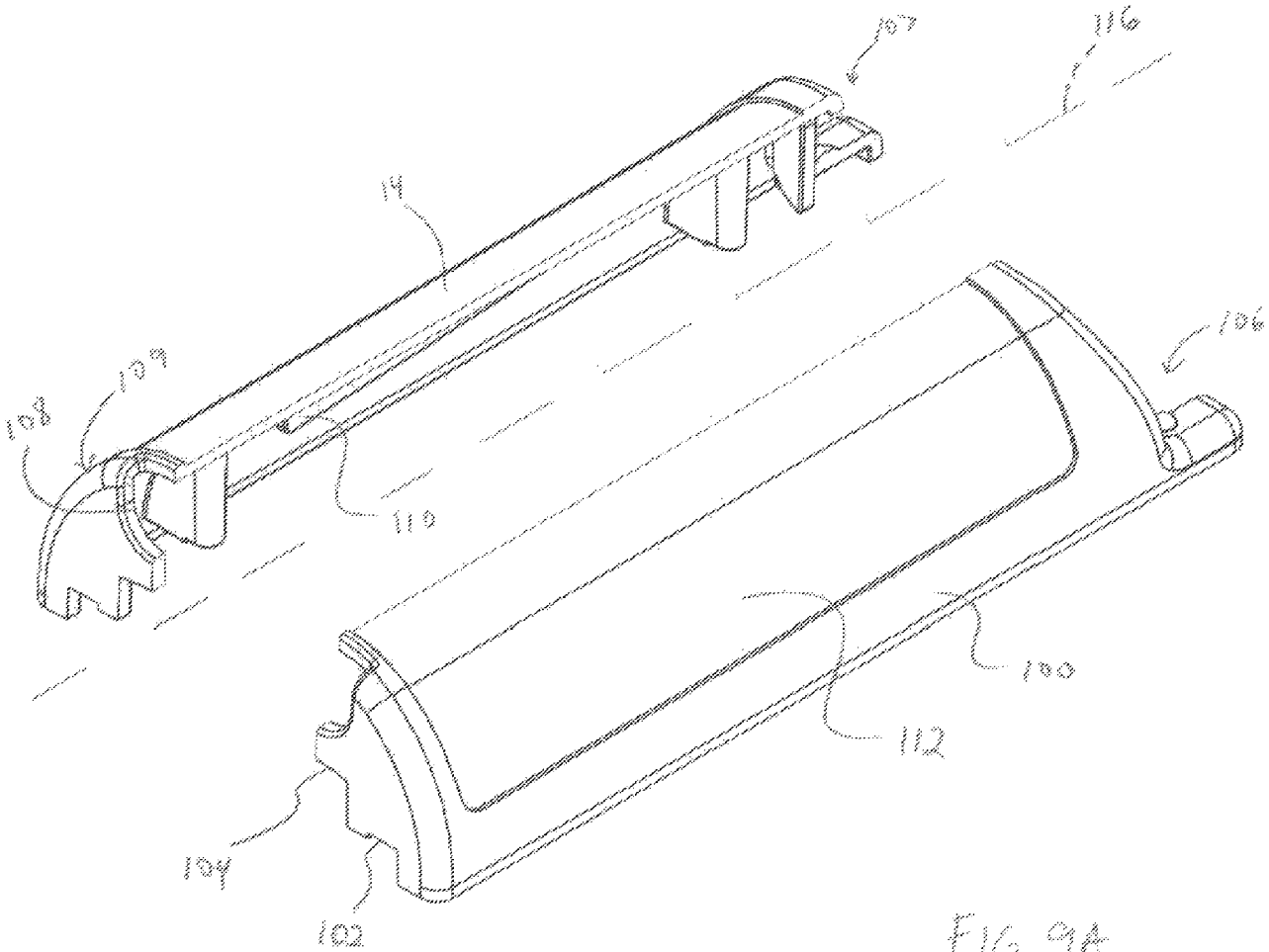
116
104
102
112
102
114
110
104
104
104

GOLF TRAINING TOOL

CROSS-REFERENCE TO RELATED APPLICATION

This application claims priority of the U.S. Provisional Patent Application filed Jun. 10, 2010 having Ser. No. 61/353,309.

FIELD OF THE INVENTION

This invention is related to golf training tools and more particularly to training aids to aim correctly at a specific target through alignment and ball position relative to the golfer's stance.

BACKGROUND OF THE INVENTION

Prior to making a golf swing, a golfer typically stands adjacent to the golf ball and makes certain alignments. For example, a golfer may determine the optimal distance necessary to stand relative to the ball. In addition, a golfer may rotate their feet relative to the ball in an effort to position their body in an optimal position such that the swing will result in the golf ball being struck and initiated in a direction generally toward the target. Sometimes it can be challenging for a golfer to properly align their feet.

Currently golfers may attempt to improve their golf setup positioning during practice or training sessions by utilizing long straight rods or their golf clubs lying upon the ground. The straight lines give a visual cue to the golfer allowing them to properly address the ball. These sticks, however, must continuously be repositioned and their relative positions/angles must be adjusted as the underlying practice grounds are damaged (e.g., divots) while practicing.

While the prior art discussed above provides a rudimentary system for aiding a golfer in properly addressing a golf ball, there are no current devices that incorporate both target alignment and ball position with a movable ball indicator.

SUMMARY OF THE INVENTION

The broad purpose of the present invention is to provide a golf training device that provides a golfer with an alignment aid that shows an ideal target line along with a ball positioning indicator. In this manner, a golfer can easily repeat a proper alignment or stance relative to the desired direction of a golf shot.

In the preferred embodiment, the device includes an elongated rail and a mating dial that slides along the rail. A guide rod is coupled to the dial which is rotatable such that the guide rod can be positioned either in parallel with the rail or perpendicular thereto.

Prior to hitting a golf ball to a given target an individual must first select that target. Then he/she would have to set up to hit the golf ball to that target. Using the present invention aids the golfer in correcting his set up prior to hitting the golf ball so that hitting the desired target is easier. The present invention is placed upon the ground pointing directly at the target. The ball pointer points directly at the golf ball. The golfer would then stand with the device between his feet and the golf ball so that his feet, hips, and shoulders are parallel to the target line and 90 degrees to the ball position line. After hitting the ball another ball would be brought into position and the ball pointer adjusted to point directly at the ball by sliding the pointer along the T-guide rail as needed.

Although there are aids that help in target alignment for the golf swing there are none existing that addresses both target alignment and ball position with an adjustable ball indicator.

It is an advantage of the present disclosure to provide a golf training tool including an elongated rail, a rod, and means for attaching the rod to the rail. Wherein the rod is slidable along the rail and is rotatable relative to the rail such that the rod is moveable between a stowed position where the rod and rail are in parallel and a deployed position where the rod and rail are perpendicular.

It is another advantage of the present invention to provide a golf training tool including an elongated rail having a flat base strip and a raised projection with generally T-shaped cross-section running the length of the strip; a rod having a substantially straight shaft; and an attachment member having a cap which is rotatably mounted to a body. The body having a cavity formed within a bottom surface which is complementary to the T-shaped projection, wherein the rod is coupled to the cap such that the cap and rod are moveable between a stowed position where the rod shaft and rail are in parallel and a deployed position where the rod shaft and rail are perpendicular.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views and in which:

The drawings described herein are for illustrative purposes only of selected embodiments and not all possible implementations, and are not intended to limit the scope of the present disclosure.

FIG. 9A is a phantom perspective view of a handle of the alignment aid;

Corresponding reference numerals indicate corresponding parts throughout the several views of the drawings. Example embodiments will now be described more fully with reference to the accompanying drawings.

DETAILED DESCRIPTION OF THE INVENTION

Figure 1:
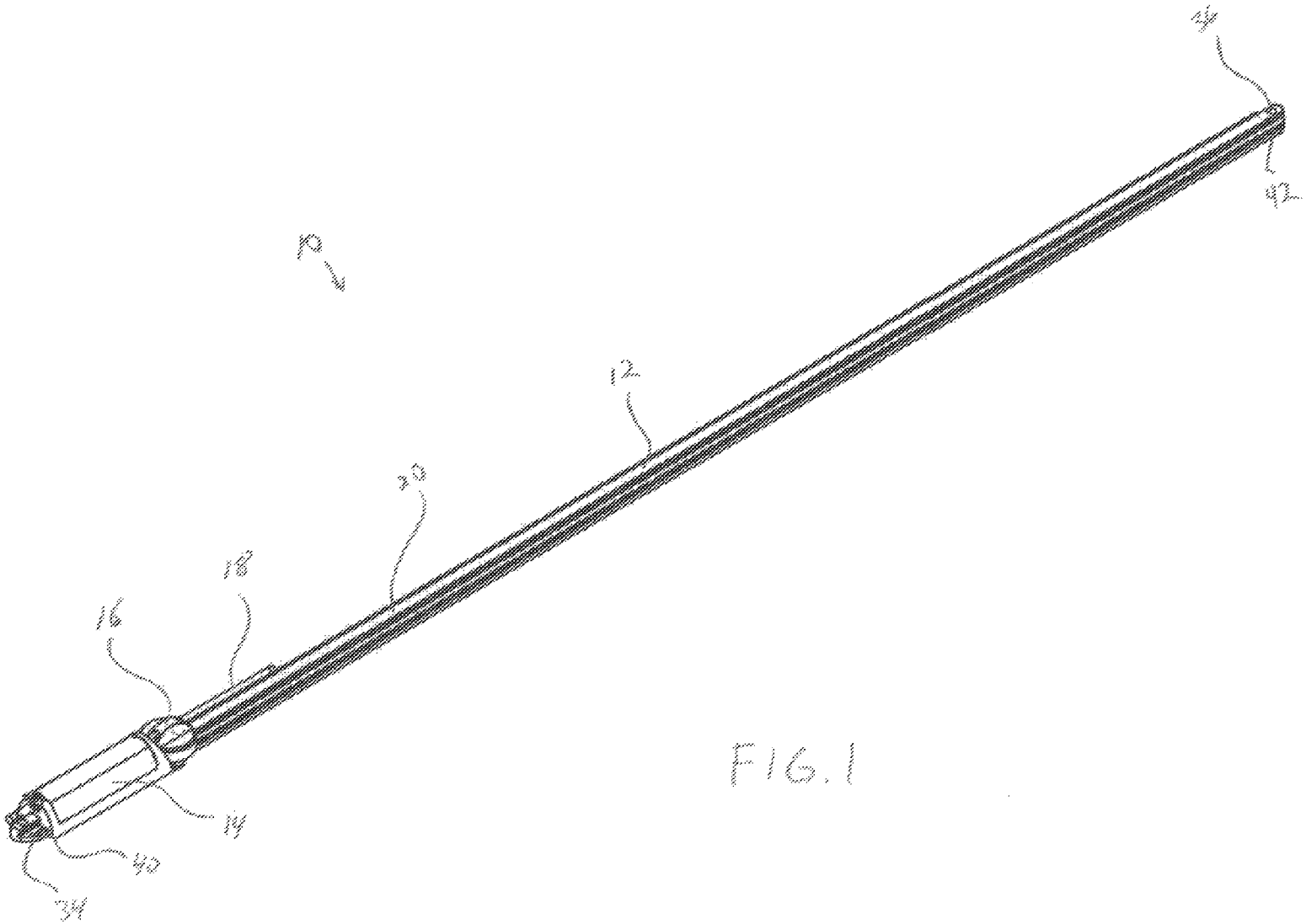
FIG. 1 is a perspective view of the alignment aid shown with the aiming portion in a storage position.

Referring now to the Figs., with initial reference to FIGS. 1-7, an alignment aid constructed in accordance to one example of the present teachings is shown and generally identified at reference numeral 10. The alignment aid 10 generally includes a T-guide or rail 12, a handle 14, a dial portion 16, and a rod 18. The T-guide 12 generally defines a cross-sectional T-shape (FIG. 7) that provides a track 20 projecting from a wider flat strip or foot 21. The dial portion 16 includes a top cap 22 and a bottom base 24. As discussed herein the top cap 22 is configured to rotate relative to the bottom base 24. The bottom base 24 includes a pair of opposing arms 26 that cooperate to form a channel 30 that the track 20 is received there within. As will become appreciated from the following discussion, the dial portion 16 is operable to slidably translate along the T-guide 12 until a desired use location is attained (such as FIG. 6). The dial portion 16 is permitted to slide along the T-guide 12 by the interaction of the track 20 of the T-guide 12 and the channel 30 of the bottom base 24.

The T-guide 12 includes holes 34 and 36 at opposite ends 40 and 42, respectively. In some examples, the holes 34 and 36 can be used to accept a positioning stake (not specifically shown) there through. A positioning stake, such as a golf tee, can be used to secure the T-guide 12 relative to the ground. The positioning stakes can be passed through the respective holes 34 and 36 (or just one of the holes 34 and 36) and into the ground.

Turning now to FIGS. 10*a*-10*d*, the bottom base 24 will be described in greater detail. The bottom base 24 has a cylindrical body portion 50 having a bottom surface 52 and a top surface 54. A shelf 56 is formed around a radial sidewall of the top surface 54. A pair of generally opposing annular lips 60 and 62 (FIG. 10*d*) are formed on the top surface. A series of depressions 64 extend into the top surface 54. While the specific example has four depressions 64, additional or fewer may be provided. The depressions 64 are preferably arranged at equivalent angles around the top surface relative to each other. In the example provided, the depressions 64 are generally arranged at 90 degrees relative to an adjacent depression 64. Each depression generally has a leading and trailing ramped surface 66 and 68, respectively. The body portion 50 can have a pair of locating tabs 70 offset from a central boss 72. A pair of cantilevered fingers 74 can extend from the body portion 50. The lower surfaces of these fingers cooperate to define the upper wall of channel 30. In one preferred embodiment, the fingers 74 can be adapted to deflect into the channel 30 to provide a biasing force on the T-guide 12.

Turning now to FIGS. 11*a*-11*d*, the top cap 22 will now be described in greater detail. The top cap 22 generally comprises a top surface 76, a bottom surface 78 and a body portion 80 that includes a raised gripping portion 82 projecting from the top surface 76 and containing a central passage 84. The central passage 84 is sized to accept a generally cylindrical elongated rod 18 while allowing the rod to slide axially within the passage 84. An annular guide rail 86 at least partially extends from the bottom surface 78. According to one example, the annular guide rail 86 is concentric to and slidably engages the locating tabs 70 extending from the bottom base 24 (i.e., the radially inner wall of rail 86 abuts the radially outer wall of tabs 70).

A pair of fingers 88 having respective undercut ledges 89 extend generally outwardly from the body portion 80. The fingers 88 slidably cooperate and rotate around the respective annular lips 60 and 62. The undercut ledges 89 hook generally under the respective annular lips 60 and 62. A series of extensions 90 extend from the bottom surface 78. The extensions 90 are formed at equal intervals (such as 90 degrees for example) around the bottom surface 78. While the specific example has four extensions 90, additional or fewer extensions can be provided. In one example, the number of extensions 90 correspond to the number of depressions 64.

Figure 2:
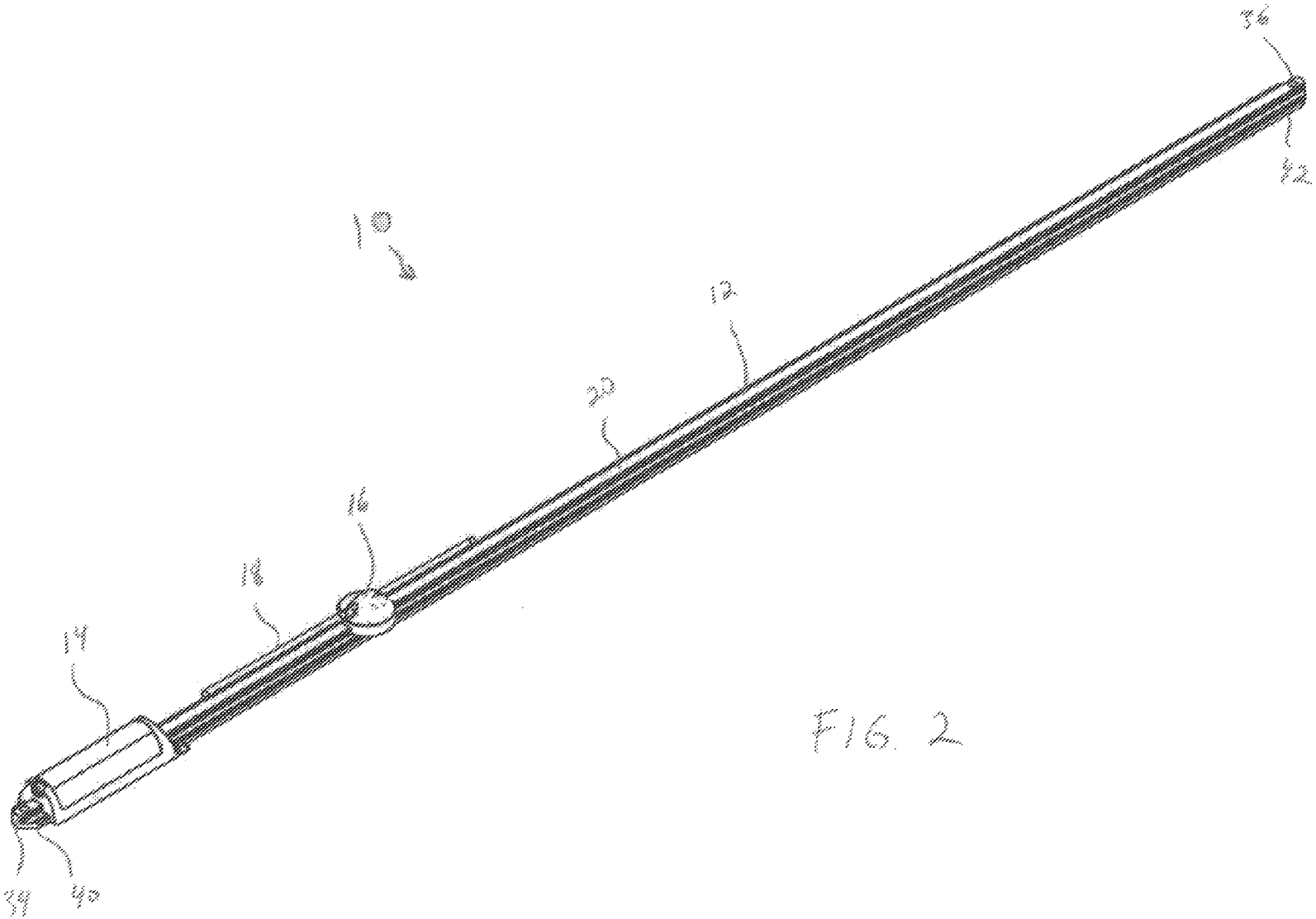
FIG. 2 is a perspective view of the alignment aid of FIG. 1 shown with the aiming portion moved to a use position.
Figure 3:
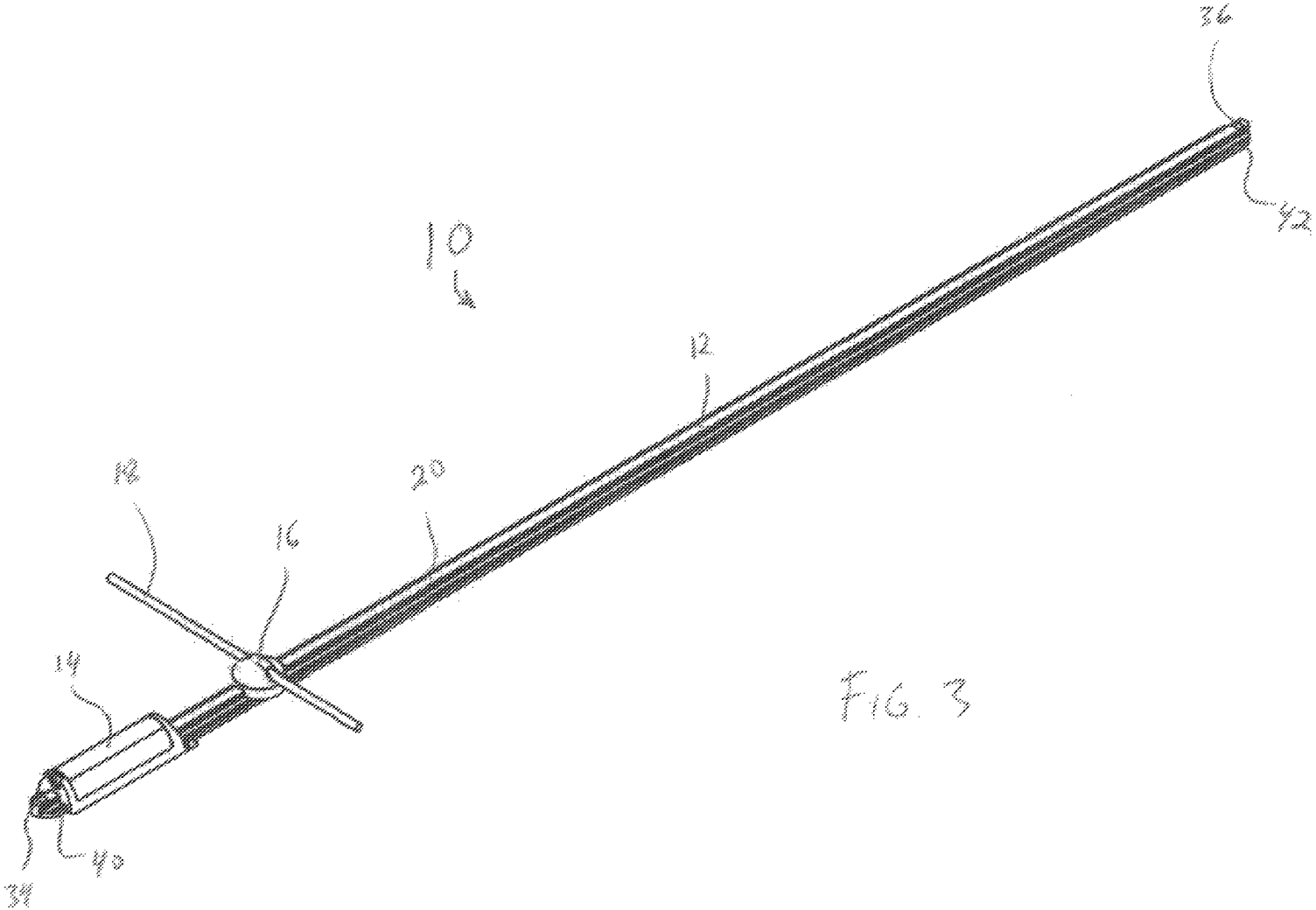
FIG. 3 is a perspective view of the alignment aid of FIG. 1 shown with the aiming portion rotated to an aiming position.

During use, the respective extensions 90 are adapted to locate into the depressions 64 to positively locate the top cap 22 relative to the bottom base 24. The ramps 66 and 68 of the bottom base 24 facilitate the extensions 90 to slidably negotiate into and out of the depressions 64. The ramps 66 and 68 that are positioned on opposite ends of the depressions 64 encourage the extensions 90 to positively locate and nest into the depressions 64 as a user rotates the cap-housed rod 18 between the aiming position (FIG. 3) and use/storage positions (FIG. 2, FIG. 1). In this regard, the interaction of the extensions 90 and the depressions 64 gives a user positive tactile feedback to ensure the rod 18 is in either the 90 degree aligning position or the use/storage position. In one non-limiting example, as the top cap 22 rotates between the use and aiming position (or when the extensions 90 are riding along the shelf 56) the undercut ledges 89 of the fingers 88 engage the annular lips 60 and 62 and provide a slight resistance to rotation. In other examples, the undercut ledges 89 of the fingers 88 can be offset from the annular lips 60 and 62.

In one embodiment, a pair of feet 94 extend from the bottom surface 78. The feet 94 can be configured to engage and deflect the fingers 74 into the channel 30 when the top cap 22 is in the storage position effective to engage the T-guide rail 12 and lock the dial 16 against further movement along the rail. Additionally or alternatively, the feet 94 can deflect partially into the passage 84 as a result from interfacing the fingers 74 to provide an interference fit against the rod 18.

Figure 4:
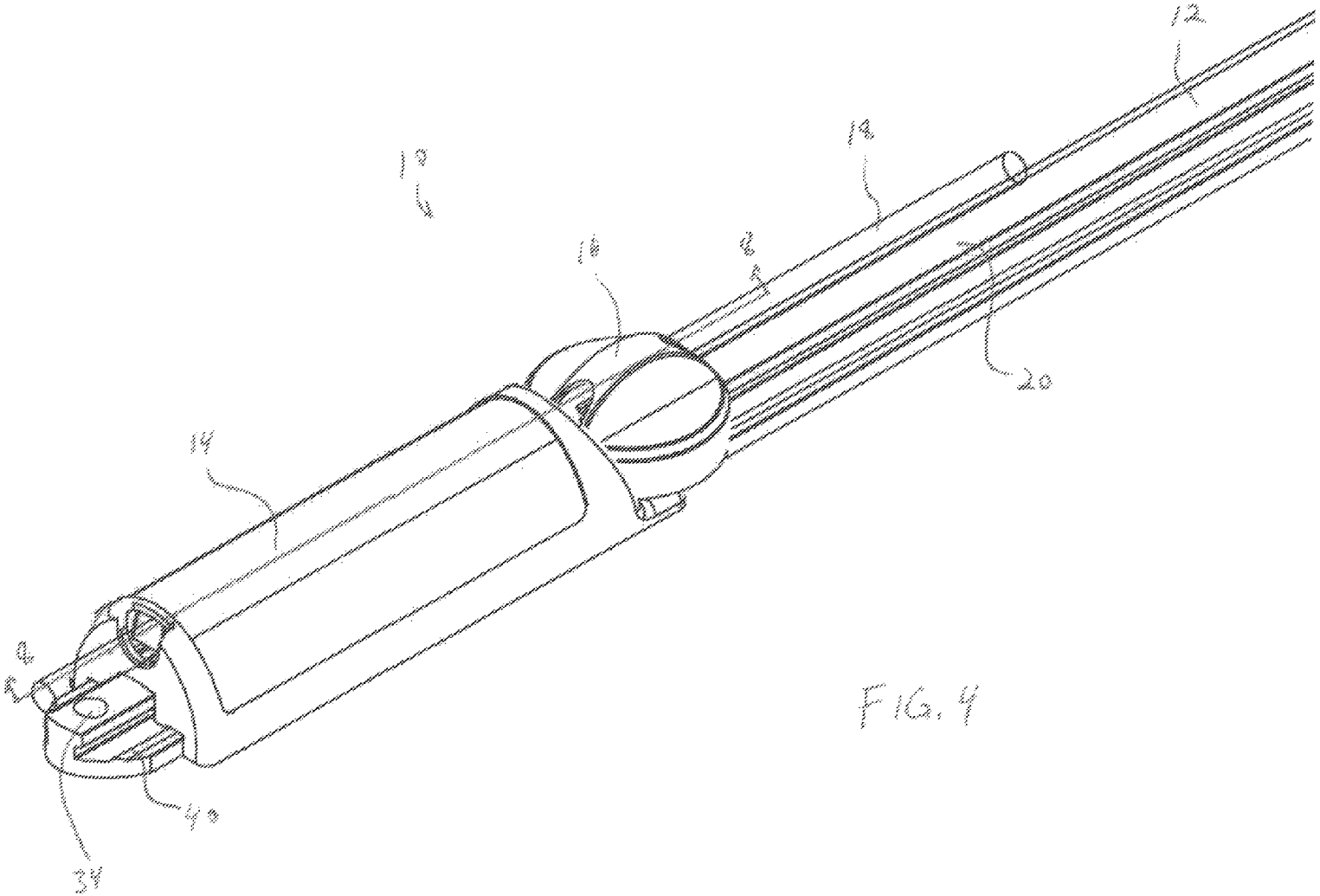
FIG. 4 is a detail perspective view of the alignment aid shown in the storage position.
Figure 5:
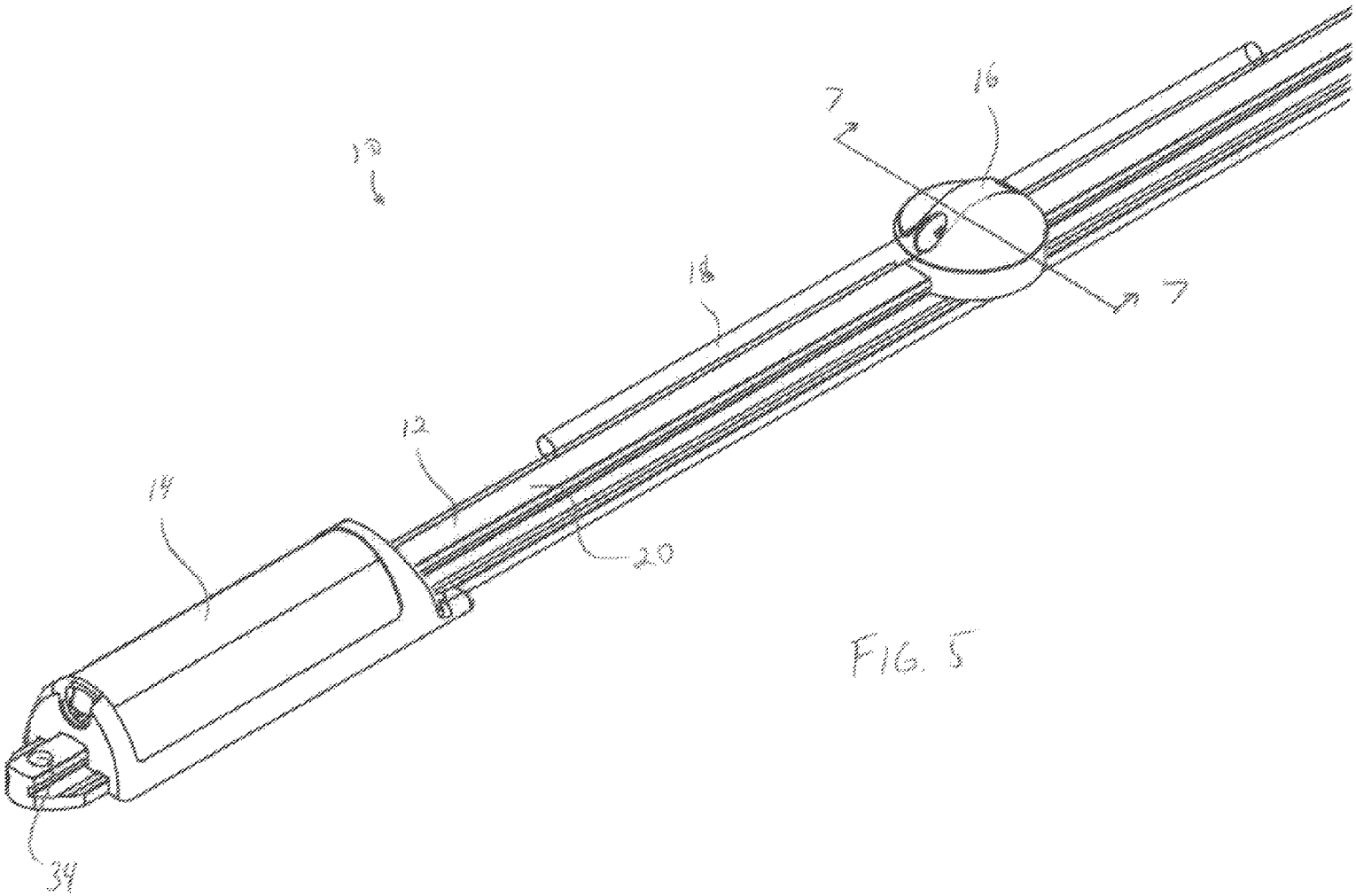
FIG. 5 is a detail perspective view of the alignment aid shown in the use position.
Figure 6:
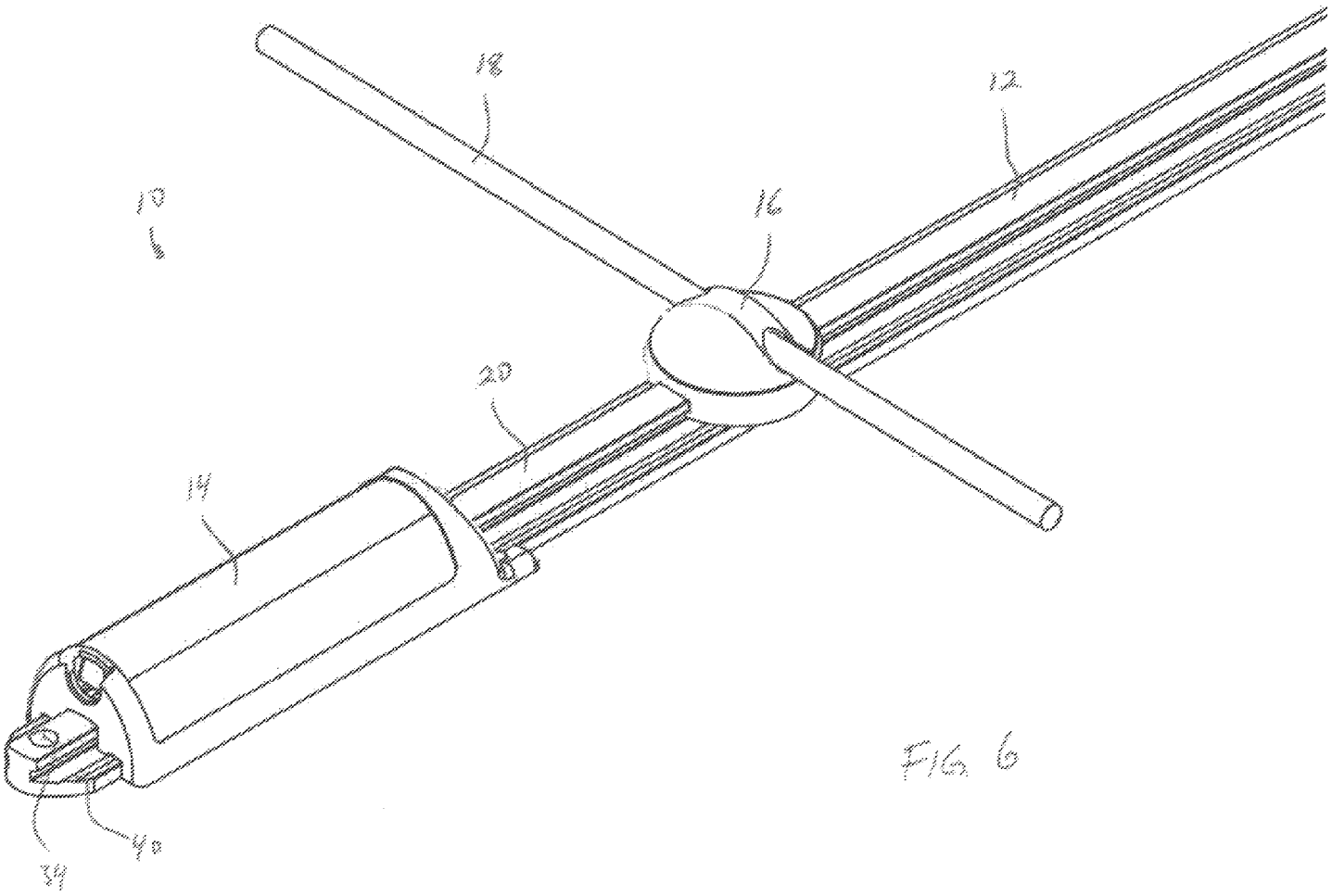
FIG. 6 is a detail perspective view of the alignment aid shown in the aiming position.
Figure 7:
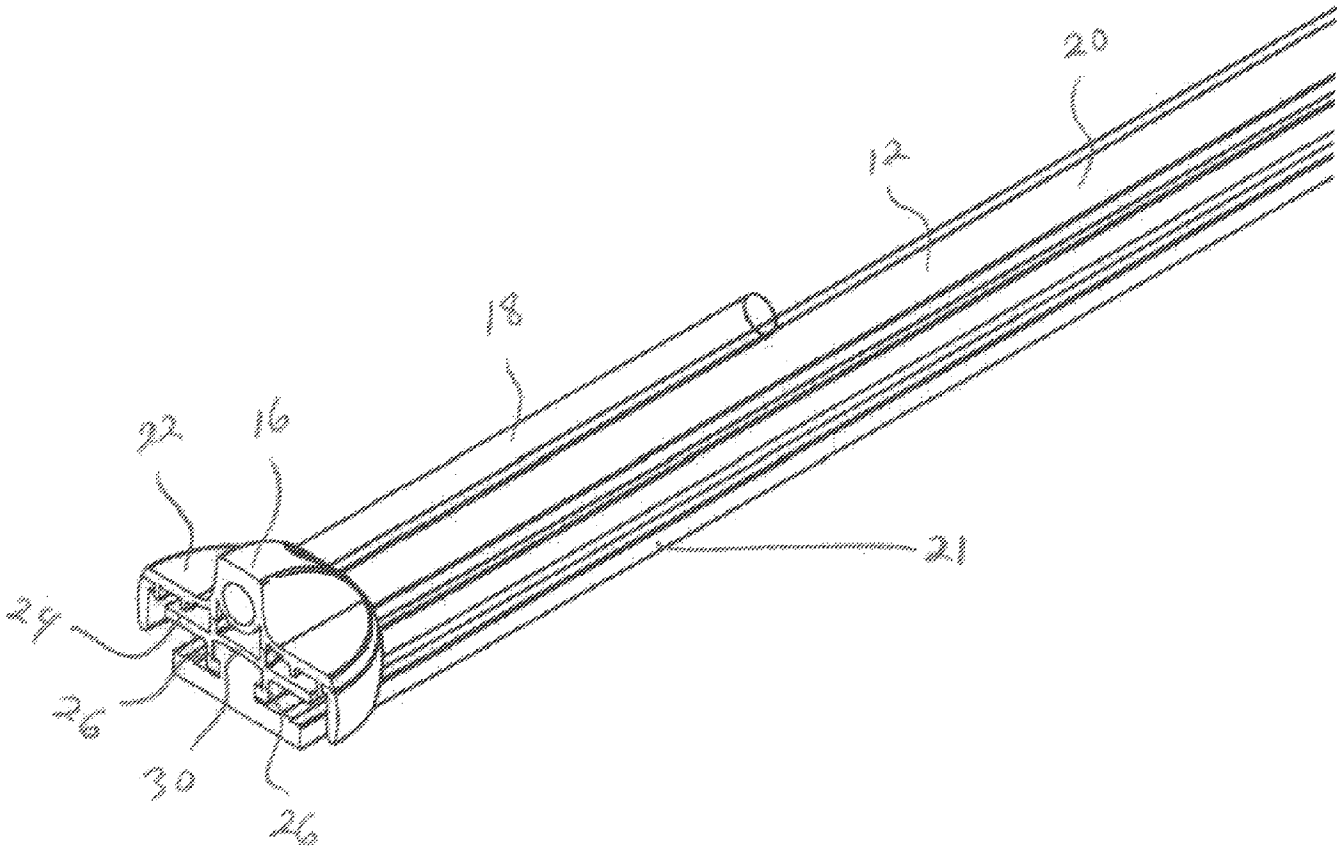
FIG. 7 is a cross-sectional view of the alignment aid taken along line 7-7 of FIG. 5.
Figure 8:
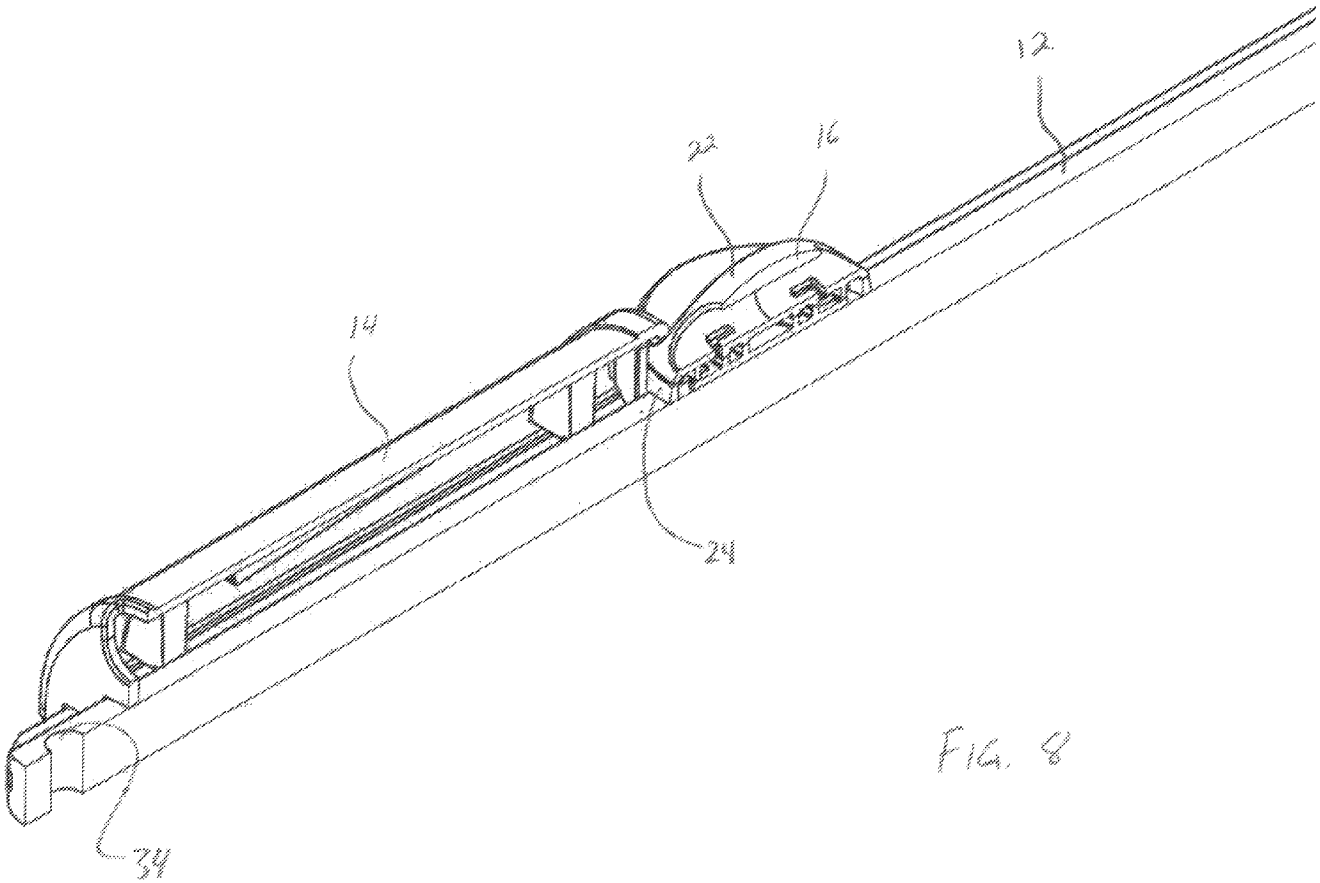
FIG. 8 is a cross-sectional view of the alignment aid taken along line 8-8 of FIG. 4.
Figure 9C:
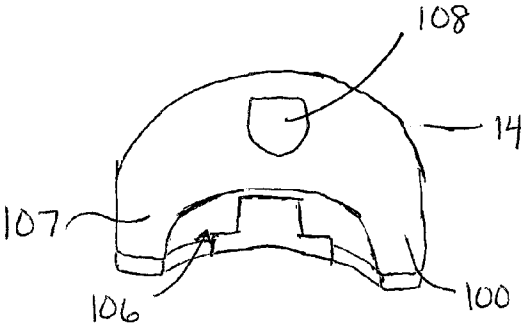
FIG. 9C is a side view of the handle showing the dial receiving pocket.
Figure 9B:
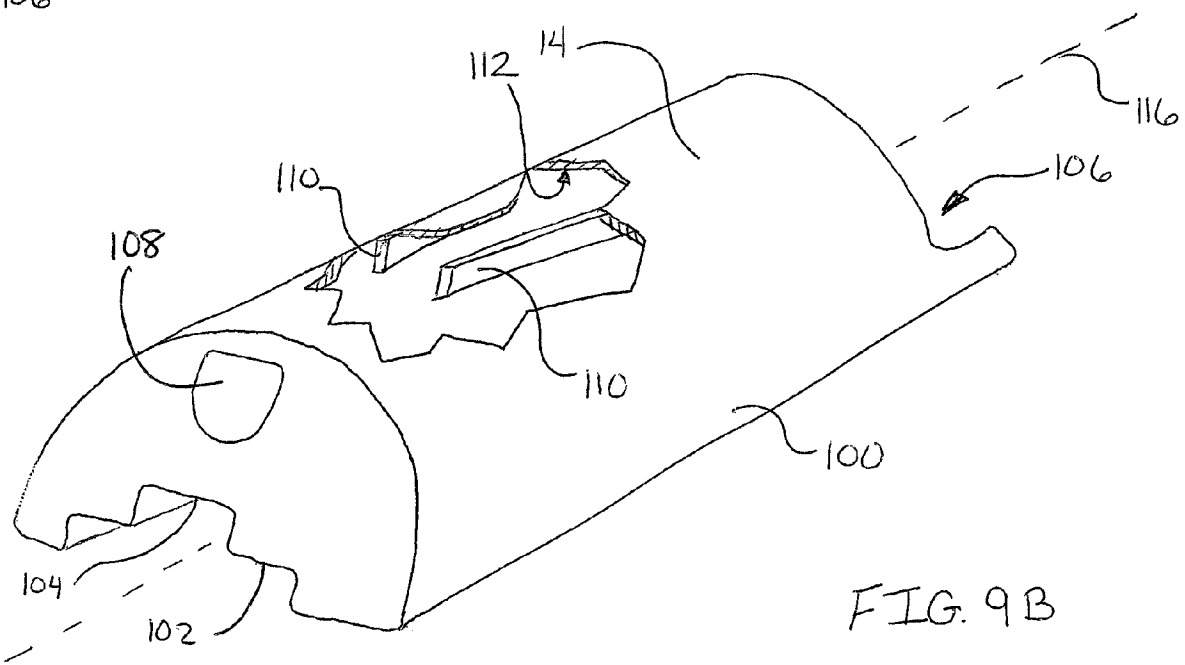
FIG. 9B is a partial cutaway view of the handle.
Figure 10B:
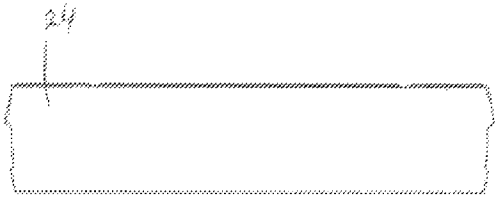
FIG. 10*b* is a side view of the bottom portion of the alignment aid.
Figure 10D:
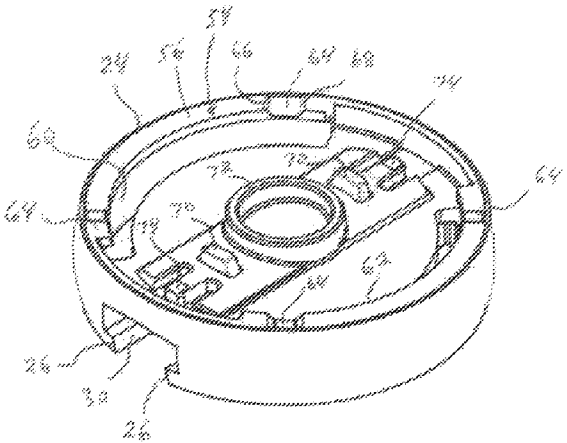
FIG. 10*d* is a top perspective view of the bottom portion of the dial of the alignment aid.
Figure 10A:
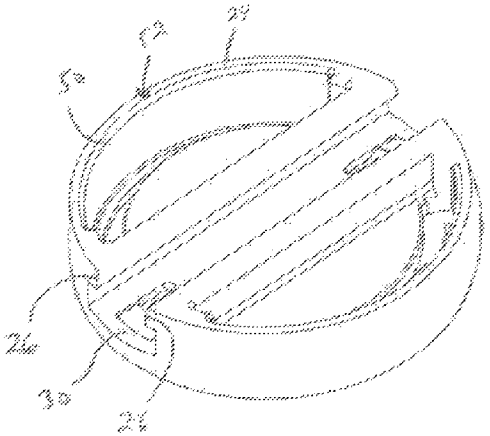
FIG. 10*a* is a bottom perspective view of a bottom portion of a dial of the alignment aid.
Figure 10C:
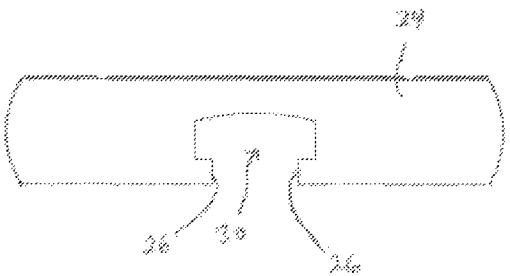
FIG. 10*c* is a front view of the bottom portion of the alignment aid.
Figure 11B:
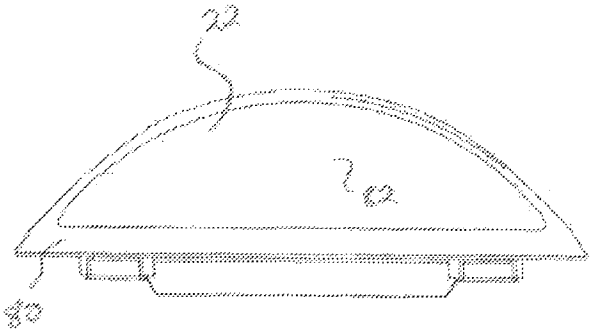
FIG. 11*b* is a side view of the top portion of the alignment aid.
Figure 11D:
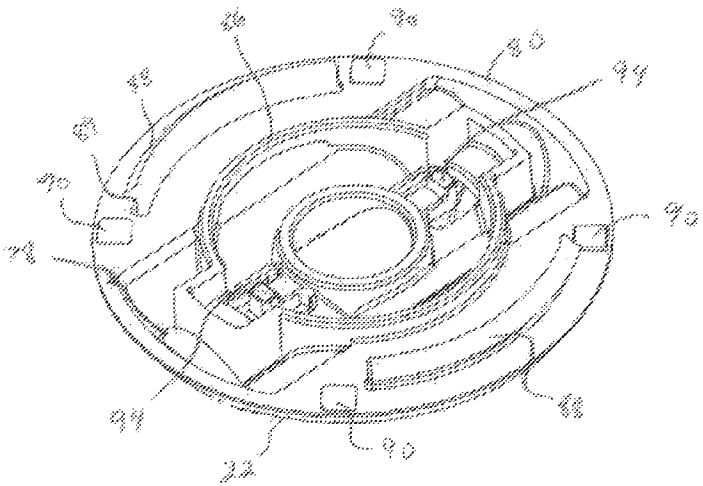
FIG. 11*d* is a bottom perspective view of the top portion of the dial of the alignment aid.
Figure 11A:
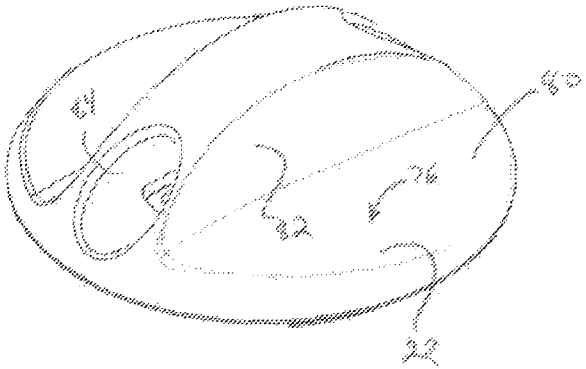
FIG. 11*a* is a top perspective view of a top portion of the dial of the alignment aid.
Figure 11C:
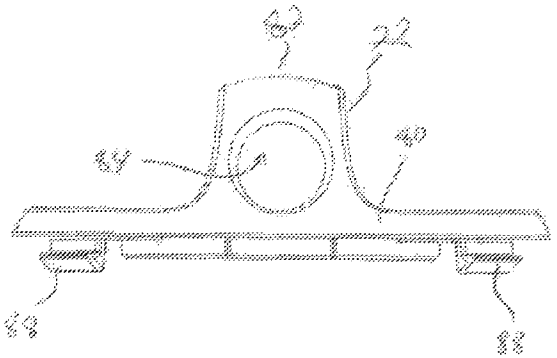
FIG. 11*c* is a front view of the top portion of the alignment aid.

Turning now to FIGS. 9A-9C, the handle 14 is shown. The handle 14 has a semi-cylindrical body 100 that defines a first and a second stepped-in surfaces 102 and 104, respectively, that extend along the length of the semi-cylindrical body 100. The stepped in surfaces 102 and 104 can collectively define the opening that accepts the T-guide 12. A pocket 106 can be formed at a first end 107 of the handle 14 for at least partially receiving the dial 16 (see also FIG. 4). An opening 108 can be provided an opposite second end 109 for accepting the rod 18 in the storage position (FIG. 4). At least one rail 110 extends from an interior wall 112 of the body 100. Each rail 110 defines a non-parallel angle with respect to a longitudinal axis 116 of the semi-cylindrical body 100. According to one example, the rail or rails 110 can act to provide a tensioning force against the rod 18 when the rod 18 is in the storage position (FIG. 4). Explained in greater detail, the opening 108 of the handle 100 and the passage 84 of the top cap 22 can cooperate to position the rod 18 while the rail 110 concurrently tensions an intermediate portion of the rod 18 (pushes the rod effectively in a direction generally transverse to the longitudinal axis 116). The interaction of the rail 110 encourages the rod to remain affixed in the storages position (FIG. 4).

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. For example, while the T-guide 12 structure has been described as being received into the channel 30 of the dial 16, these features may be reversed with the rail 12 having the channel and the dial 16 having a T-shaped structure. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

From the foregoing description, one skilled in the art will readily recognize that the present invention is directed to a golf training tool having adjustable alignment portions rotatably interconnected together. The paired rail and rod cooperate to ensure that the golfer's body and feet positioned properly relative to the target line and the ball. The rod and rail are coupled together by a movable dial which retains the rod and rotates from: 1) a stowed position in which the rod and rail are substantially parallel; to 2) a deployed position, where rod and rail are perpendicular. While the present invention has been described with particular reference to various preferred embodiments, one skilled in the art will recognize from the foregoing discussion and accompanying drawings that changes, modifications, and variations can be made in the present invention without departing from the spirit and scope thereof.

The invention claimed is:

1. A golf training tool comprising:

an elongated rail having a flat base strip and a raised projection with generally T-shaped cross-section running the length of the strip;

a rod having a substantially straight shaft; and an attachment member having a cap which is rotatably mounted to a body, the body having a cavity formed within a bottom surface which is complementary to said T-shaped projection, wherein said rod is coupled to said cap such that said cap and rod are moveable between a stowed position where the rod shaft and rail are in parallel and a deployed position where the rod shaft and the rail are perpendicular.

2. A golf training tool as defined in claim 1, wherein said rod is mounted within a through bore in said cap and is moveable axially within said through bore.

3. A golf training tool as defined in claim 1, wherein said attachment member positively locates at spaced intervals upon said body as said cap is rotated upon said body.

4. A golf training tool as defined in claim 3, wherein said cap and base include spaced radially aligned projections and depressions which intermesh to positively locate said cap upon said body.

5. A golf training tool as defined in claim 4, wherein said projections abut an annular collar that is radially coextensive with the depressions when said cap is rotated upon said body but is not positively located.

6. A golf training tool as defined in claim 1, wherein said attachment member is locked in place to said rail when said rod is in said stowed position.

7. A golf training tool as defined in claim 6, wherein said base includes cantilevered finger projections which form a portion of an upper wall which defines said cavity, wherein said cap includes feet which extend from an underside of the cap and deflect said finger projections into said cavity when said cap is rotated to a certain position upon said base.

8. A golf training tool as defined in claim 7, wherein said certain position is said stowed position.

9. A golf training tool as defined in claim 1, further comprising a handle mounted to one end of said rail, the handle including a bore formed therein which is coextensive to said rod when said rod is in the stowed position.

10. A golf training tool as defined in claim 9, wherein said handle further includes at least one tensioning rail which is partially passes into and defines an angle with said handle bore, wherein said tensioning rail is friction fit with the rod when the rod is the stowed position and is inserted within said handle bore, effective to retain the rod within the handle.

11. A golf training tool comprising:

an elongated rail having a flat base strip and a raised projection with generally T-shaped cross-section running the length of the strip;

a rod having a substantially straight shaft;

an attachment member having a cap which is rotatably mounted to a body, the body having a cavity formed within a bottom surface which is complementary to said T-shaped projection, wherein said rod is coupled to said cap such that said cap and rod are moveable between a stowed position where the rod shaft and rail are in parallel and a deployed position where the rod shaft and the rail are perpendicular; and a handle mounted to one end of said rail, the handle including a bore formed therein which is coextensive to said rod when said rod is in the stowed position.

12. A golf training tool as defined in claim 11, wherein said base includes cantilevered finger projections which form a portion of an upper wall which defines said cavity, wherein said cap includes feet which extend from an underside of the cap and deflect said finger projections into said cavity when said cap is rotated to a certain position upon said base.

13. A golf training tool as defined in claim 11, wherein said cap and base include spaced radially aligned projections and depressions which intermesh to positively locate said cap upon said body as said cap is rotated upon said body.

14. A golf training tool as defined in claim 13, wherein said projections abut an annular collar that is radially coextensive with the depressions when said cap is rotated upon said body but is not positively located.

* * * * *